United States Patent [19]

Parker

[11] Patent Number: 4,518,937

[45] Date of Patent: May 21, 1985

[54] ELECTRO-HYDRAULIC SERVO VALVES AND ELECTRICAL FORCE MOTORS SUITABLE THEREFOR

[75] Inventor: Dennis W. Parker, Cheltenham, United Kingdom

[73] Assignee: Dowty Hydraulic Units Limited, England

[21] Appl. No.: 473,279

[22] Filed: Mar. 7, 1983

[30] Foreign Application Priority Data

Mar. 19, 1982 [GB] United Kingdom ..... 8208146

[51] Int. Cl.[3] ..... H01F 7/08

[52] U.S. Cl. ..... 335/229; 335/230; 335/272; 310/29; 310/36; 310/191

[58] Field of Search ..... 335/229, 230, 272; 310/36–36, 29, 190–193

[56] References Cited

U.S. PATENT DOCUMENTS

| | | | |
|---|---|---|---|
| 2,825,828 | 3/1958 | Ling | 310/191 X |
| 3,100,852 | 8/1963 | Peek et al. | 310/191 X |
| 3,435,393 | 3/1969 | Meisel | 335/237 |
| 3,471,725 | 10/1969 | Moret et al. | 310/36 |
| 3,475,629 | 10/1969 | Lagier | 310/36 |
| 3,587,016 | 6/1971 | Cookley | 335/237 |
| 4,345,228 | 8/1982 | Idogaki et al. | 310/36 X |

FOREIGN PATENT DOCUMENTS

| | | |
|---|---|---|
| 1011523 | 12/1965 | United Kingdom . |
| 1317967 | 5/1973 | United Kingdom . |
| 2013982 | 11/1978 | United Kingdom . |

*Primary Examiner*—Donovan F. Duggan

*Attorney, Agent, or Firm*—Hayes, Davis & Soloway

[57] ABSTRACT

An electrical force motor, suitable for use in electro-hydraulic servo valves, has a circular permanent magnet which is polarized across its diameter, which is disposed at least partly within one of the pole pieces of the motor and which is rotatable with respect to that pole piece to increase the effective strength of one pole of that pole piece and to decrease the effective strength of the other pole thereof.

4 Claims, 2 Drawing Figures

ELECTRO-HYDRAULIC SERVO VALVES AND ELECTRICAL FORCE MOTORS SUITABLE THEREFOR

This invention relates to electro-hydraulic servo valves and to electrical force motors suitable for use in such servo valves.

An electro-hydraulic servo valve includes a so-called electrical force motor comprising a pair of opposed pole pieces associated with permanent magnets to provide a permanent magnetic field and electrical means for superimposing on that permanent magnetic field a variable magnetic field. Between the poles of the opposed pole pieces is an armature which is caused to move from a null position to another position when a variable magnetic field is superimposed on the permanent magnetic field.

In one form of electro-hydraulic servo valve, the position of the armature determines the position of a flapper which, in turn, controls the rate of flow of liquid from a nozzle or from a pair of opposed nozzles, which flow, in turn, determines the position of a valve member. In the null position of the armature the rate of flow from the nozzle or the opposed nozzles is such that the valve member is in a null position. Movement of the armature from its null position, when subject to the variable magnetic field, causes the flow from the nozzle or the flows from a pair of opposed nozzles to change, and this causes the position of the valve member to change.

In another form of electro-hydraulic servo valve, the position of the armature determines the position of a nozzle, from which a jet of liquid discharges, with respect to two fixed orifices for receiving liquid discharged from the nozzle. The relative amounts of liquid received by the two fixed orifices determine the position of a valve member. In the null position of the armature, the amounts of liquid received by the two fixed orifices are such that the valve member is in a null position. Movement of the nozzle from its null position, when subject to the variable magnetic field, causes one fixed orifice to receive more liquid than the other, and this causes the position of the valve member to change.

Sometimes, it is desirable to move the armature of an electrical force motor when it is not subject to an imposed variable magnetic field. For example, it may be necessary to adjust the position of the armature between the poles of the opposed pole pieces to ensure that it is in an accurate null position before the application of an imposed variable magnetic field. Alternatively, or additionally, it may be necessary manually to move the armature in order to cause effective manual movement of the valve member to a desired position; for example, to move the valve member from one position to another position if the means providing the imposed variable magnetic field fails when the valve is in use.

It is an object of this invention to provide an improved electrical force motor. It is another object of this invention to provide an improved electro-hydraulic servo valve.

According to this invention, an electrical force motor has a circular permanent magnet, polarised across its diameter, disposed at least partly within one of the pole pieces and rotatable with respect to that pole piece.

The circular magnet may be carried for rotation with respect to the pole pieces by the cap which encloses the electrical force motor.

Also, according to this invention, an electro-hydraulic servo valve includes an electrical force motor having a circular permanent magnet, polarised across its diameter, disposed at least partly within one of the pole pieces and rotatable with respect to that pole piece.

Rotation of the circular magnet has the effect of increasing the magnetic attraction of the armature towards one or other of the pole pieces, depending on the polarity of the circular magnet and the direction of rotation.

When an electro-hydraulic servo valve in accordance with the invention has an armature connected to a flexure tube and a flapper, which act between a pair of opposed nozzles, the axis of rotation of the circular magnet may be coaxial with the axis of the flexure tube and its associated flapper.

An electro-hydraulic servo valve having an electrical force motor in accordance with one embodiment of the invention, and given by way of example thereof, is illustrated in the accompanying drawings.

Figure 1:
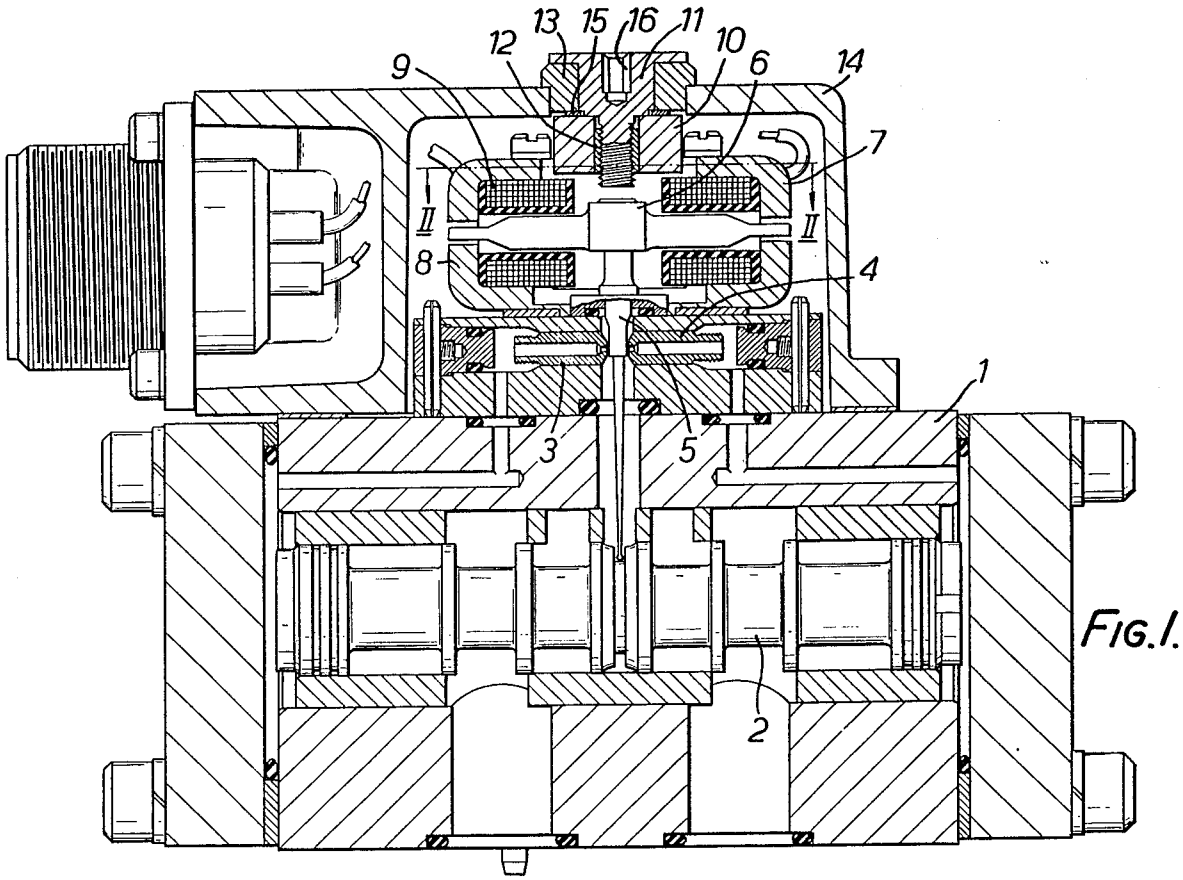
FIG. 1 is a vertical sectional elevational view of the servo valve.
Figure 2:
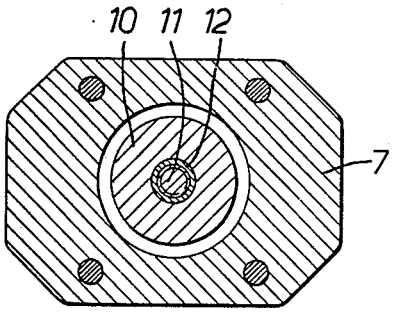
FIG. 2 is a section taken along the line II—II of FIG. 1.

Referring to the drawings, the electro-hydraulic servo valve includes a valve body 1, a valve member 2 movable in the valve body and two opposed nozzles 3, 4, the flows of liquid from which nozzles determine the position of the valve member 2.

The flows of liquid from the nozzles are controlled by a flexure tube/flapper device 5 connected to the central area of an armature 6 which is part of the electrical force motor. Each end of the armature 6 is located between the poles of a pole piece 7 and a pole piece 8 (associated with permanent magnets, not shown) which provide a permanent magnetic field. An electrical means, a coil 9, associated with the pole pieces 7 and 8 provides, when suitably energised, a variable magnetic field imposed upon the permanent magnetic field.

The central area of the upper pole piece 7 has a circular opening in which is disposed part of a circular permanent magnet 10, polarised across a diameter.

The circular magnet may be a samarium/cobalt magnet and may be sealed on its external surfaces, say by polyurethane, to prevent possible migration of particles which could become trapped in the magnetic circuit and thus cause malfunction.

The circular permanent magnet 10 is connected to the depending part of magnet-carrying pin 11 by way of an expandable serrated collet 12 which ensures positive, slip-free, retention of the circular magnet on the pin. The upper part of the magnet-carrying pin 11 fits rotatably within the bush 13 fixed in the motor cap 14 of the valve, which cap is secured to the valve body 1. Rotation of the pin 11 within the bush causes rotation of the circular magnet.

A shoulder is provided on the underside of the upper part of the magnet-carrying pin 11 and a "wavy" washer 15 is fitted between the shoulder and the lower-side of the bush 13 and the upper surface of the circular permanent magnet 10. This provides a friction lock by which the circular permanent magnet remains in a position to which it has been moved by rotation of the pin 11.

Rotation of the pin may be achieved by the insertion of a suitable tool placed in a suitably-shaped recess 16 in the pin.

When the direction of polarisation of the circular permanent magnet is at right-angles to the direction of the lines of magnetic flux in the upper pole piece 7, the former will have little effect on the position of the armature. Rotating the circular permanent magnet from that position will increase the effective strength of one pole of the upper pole piece and decrease the effective strength of its other pole. This will create an out-of-balance force, whose value will depend on the amount through which the circular permanent magnet has been turned. That out-of-balance force will cause one end of the armature to move towards one pole and away from the other.

As the component parts of the circular permanent magnet assembly are completely symmetrical about the rotational axis, they will not be subject to out-of-balance forces arising from shock or vibration to which the electrical force motor may be subjected in use. Thus, it is extremely stable under extreme environmental conditions.

Furthermore, since in the above described electro-hydraulic servo valve the axis of rotation of the circular permanent magnet is coaxial with respect to the axis of the flexure tube/flapper device 5, the motor cap 14 of the electrical force motor may be oriented with respect to the valve body in any of several positions.

I claim:

1. An electrical force motor having first and second pole pieces, an armature having a portion thereof disposed between poles of the first and second pole pieces for movement relative thereto and a circular permanent magnet, polarized across a diameter thereof, disposed at least partly within and between poles of one of the pole pieces and rotatably adjustable with respect to that pole piece magnetically to adjust the position of the armature relative to the pole pieces.

2. An electrical force motor as claimed in claim 1 in which the circular magnet is carried for rotational adjustment by a cap enclosing the force motor.

3. An electro-hydraulic servo valve having an electrical force motor having first and second pole pieces, an armature having a portion thereof disposed between poles of the first and second pole pieces for movement relative thereto and a circular permanent magnet, polarized across a diameter thereof, disposed at least partly within and between poles of one of the pole pieces and rotatably adjustable with respect to that pole piece magnetically to adjust the position of the armature relative to the pole pieces.

4. An electro-hydraulic servo valve as claimed in claim 3 having a flexure tube/flapper device in which the axis of rotation of the circular permanent magnet and the axis of the flexure tube/flapper device are coaxial.

* * * * *